US010660816B2

(12) United States Patent
Limoni et al.

(10) Patent No.: US 10,660,816 B2
(45) Date of Patent: May 26, 2020

(54) SURGICAL SUPPORT FOR PROVIDING KNEE TORSION

(71) Applicants: BAYCARE CLINIC, LLP., Green Bay, WI (US); FUSED INNOVATION, LLC, Neenah, WI (US)

(72) Inventors: Robert P. Limoni, Green Bay, WI (US); David Kettner, Greenville, WI (US)

(73) Assignees: BayCare Clinic, LLP, Green Bay, WI (US); Fused Innovation, LLC, Neenah, WI (US)

( * ) Notice: Subject to any disclaimer, the term of this patent is extended or adjusted under 35 U.S.C. 154(b) by 0 days.

(21) Appl. No.: 16/359,013

(22) Filed: Mar. 20, 2019

(65) Prior Publication Data

US 2019/0216666 A1 Jul. 18, 2019

Related U.S. Application Data

(63) Continuation of application No. 15/077,445, filed on Mar. 22, 2016, now Pat. No. 10,265,235.

(60) Provisional application No. 62/300,436, filed on Feb. 26, 2016, provisional application No. 62/136,810, filed on Mar. 23, 2015.

(51) Int. Cl.
*A61G 13/12* (2006.01)

(52) U.S. Cl.
CPC ..... *A61G 13/1245* (2013.01)

(58) Field of Classification Search
CPC ..... A61G 13/12
USPC ..... 5/624, 621, 648
See application file for complete search history.

(56) References Cited

U.S. PATENT DOCUMENTS

| | | | | |
|---|---|---|---|---|
| 4,299,213 | A | 11/1981 | Violet | |
| 4,549,540 | A | 10/1985 | Caspari et al. | |
| 4,615,516 | A | 10/1986 | Stulberg et al. | |
| 4,854,313 | A | 8/1989 | Kloepper | |
| 5,025,802 | A | 6/1991 | Laico et al. | |
| 5,056,535 | A | 10/1991 | Bonnell | |
| 5,560,577 | A * | 10/1996 | Keselman | A61F 5/3761 248/229.25 |
| 5,799,349 | A * | 9/1998 | Petersen | A61G 13/0063 5/624 |
| 6,582,384 | B1 | 6/2003 | Henry | |
| 7,947,006 | B2 | 5/2011 | Torrie et al. | |
| 9,480,614 | B2 | 11/2016 | Torrie et al. | |
| 2012/0233782 | A1 | 9/2012 | Kreuzer et al. | |

FOREIGN PATENT DOCUMENTS

| | | | |
|---|---|---|---|
| WO | 0145601 | A2 | 6/2001 |
| WO | 2013119688 | A1 | 8/2013 |

* cited by examiner

*Primary Examiner* — Fredrick C Conley
(74) *Attorney, Agent, or Firm* — Boyle Fredrickson S.C.

(57) ABSTRACT

The present invention provides a fixture that may be releasably attached to the operating table to apply two countervailing forces to the leg on opposite sides of the knee. These forces permit the application of a precise and stable torque to the knee joint. In one embodiment, the fixture may be repositioned and fixed with respect to the operating table through the surgical drape without penetration of the surgical drape.

22 Claims, 6 Drawing Sheets

SURGICAL SUPPORT FOR PROVIDING KNEE TORSION

STATEMENT REGARDING FEDERALLY SPONSORED RESEARCH OR DEVELOPMENT

- - -

CROSS REFERENCE TO RELATED APPLICATION

This application is a continuation of U.S. patent application Ser. No. 15/077,445 filed Mar. 22, 2016, which claims the benefit of U.S. provisional application 62/136,810 filed Mar. 23, 2015 and U.S. provisional application 62/300,436 filed Feb. 26, 2016, each of which are hereby incorporated in their entireties by reference.

BACKGROUND OF THE INVENTION

The present invention relates to a surgical support system for supporting a patient during surgery and in particular to a support system that can be attached to and adjusted with respect to the operating table to provide torsion to the knee joint.

During knee surgeries and procedures it is often necessary to apply torsional forces to the knee in order to open or stress the lateral or medial sides of the joint. For example, during arthroscopic surgeries, controlled manipulation of the joint is necessary to allow viewing by an arthroscope and access to the compartments of the knee for repair. When the knee is extended, the lateral and medial gutters may be exposed. When the knee is flexed, the notch and groove of the femur may be exposed. When varus medial and valgus lateral stresses are applied to the knee, the meniscus may be exposed. The type and degree of stress placed on the knee varies during the course of surgery.

As standard practice, these forces are applied manually by grasping the foot or ankle and pushing or pulling the foot or ankle in a direction perpendicular to the normal extent of the leg and with the knee held fixed by a post by a hand placed aside the knee. This process is inconsistent, unstable, and usually requires a second person to apply the force.

SUMMARY OF THE INVENTION

The present invention provides a fixture that may be releasably attached to the operating table to apply two countervailing forces to the leg on opposite sides of the knee. These forces permit the application of a precise and stable torque to the knee joint. In one embodiment, the fixture may be repositioned and fixed with respect to the operating table through the surgical drape without penetration of the surgical drape using the techniques described in co-pending application Ser. No. 14/255,131 filed Apr. 17, 2014, and hereby incorporated by reference.

Specifically, the invention provides a surgical leg positioning unit for positioning a leg of a human patient with the patient lying supine on an upper surface of a surgical table and the patient's inferior/superior axis generally aligned with an axis of the table. The positioning unit has a soleplate for receiving the patient's foot of the leg when the patient's knee of the leg is bent and extending upward from the table and restraining the foot against free angulation; a resistive post positioned to abut a lateral side of a thigh of the leg of the patient and cooperating with the soleplate to provide a lateral torsion on the thigh of the patient; and a support frame adjustably receiving and retaining the soleplate and the resistive post to control a longitudinal separation between the soleplate and the resistive post along the axis of the table controlling a bending of the knee and a lateral displacement of the resistive post across the axis of the table controlling a torsion on the knee.

It is thus a feature of at least one embodiment of the invention to support the patient's leg during arthroscopic surgery by stabilizing opposite ends of the knee joint, i.e., above the patient's knee and at the foot or ankle, in order to apply a precise and stable torque to the knee joint without extraneous movement of the leg.

A first swivel joint permits the soleplate to rotate horizontally about a second axis perpendicular to the upper surface of the surgical table. A first pivot joint permits rotation of the soleplate at an angle with respect to the table about a third axis parallel to the upper surface of the surgical table. A second swivel joint permits the rail to rotate horizontally about a fourth axis perpendicular to the upper surface of the tabletop.

It is thus a feature of at least one embodiment of the invention to twist the foot or ankle to apply varus/valgus stresses in varying degrees of flexion/extension to permit examination of the knee's compartments. The varus/valgus stresses on the foot or ankle may be applied independently from the flexion/extension of the foot or ankle.

The support frame has a rail extending along a length of the upper surface of the surgical table and a slide constrained against rotation along the second and third axes coupled to the soleplate and engaging the rail to permit sliding of the soleplate horizontally along the rail. A slide constrained against rotation along the second and third axes is coupled to the resistive post and engages the rail to permit sliding of the resistive post horizontally along the rail. Relative positions of the soleplate and resistive post may be independently adjustable along the rail.

It is thus a feature of at least one embodiment of the invention to allow repositioning of the soleplate and/or the resistive post along the patient's leg according to the dimensions of the leg and to permit varying degrees of flexion and extension of the knee joint.

A post mounting plate may adjustably receive and retain the resistive post to control a position of the resistive post along a fifth axis normal to the rail. The post mounting plate may provide a plurality of laterally spaced bores selectively receiving correspondingly shaped pins of the resistive post at laterally spaced locations from the rail. A cross section of the bores and correspondingly shaped pins may be vesica piscis shaped.

It is thus a feature of at least one embodiment of the invention to allow removable and selective adjustment of the resistive post outward along a transverse plane of the body for varying degrees of abduction of the leg. The post mounting plate may allow insertion of a variety of different resistive posts (e.g., different sizes and shapes) for a variety of purposes.

The soleplate comprises a pivot point including a lock and back plate to provide a forward force on the patient's foot. A calf support may receive the patient's calf of the leg when the foot of the patient is received by the soleplate and restraining the calf against free angulation.

It is thus a feature of at least one embodiment of the invention to prevent further flexion of the knee by supporting the foot at a fixed angle of flexion/extension.

A strap may be attached at a lower side of the soleplate on a first end and the rail at an opposite second end and control a tensive force on the patient foot in a downward direction.

It is thus a feature of at least one embodiment of the invention to provide adequate plantar flexion and dorsi flexion at the patient's ankle.

A foundation may be mounted to the surgical table and provide connectors for selectively and releasably retaining the mounting plate therebetween the connectors.

It is thus a feature of at least one embodiment of the invention to allow the mounting plate to be removeably installed to the surgical table so that a sterile sheet may be positioned between the mounting plate and the table without penetration, thus providing a sterile shield.

The invention also provides a method of positioning a leg of a human patient after surgery with the patient lying supine on an upper surface of a surgical table, comprising the steps of: positioning the patient on the upper surface of the surgical table so that the patient's inferior/superior axis is generally aligned with an axis of the table; positioning the patient's foot of the leg when the patient's knee of the leg is bent and extending upward from the table into a soleplate restraining the foot against free angulation; bending a knee of the patient so that a lateral side of a thigh of the leg of the patient abuts a resistive post cooperating with the soleplate to provide a lateral torsion on the thigh of the patient; and adjusting a longitudinal separation between the soleplate and the resistive post along a support frame adjustably receiving and retaining the soleplate and resistive post along an axis of the table controlling a bending of the knee and a lateral displacement of the resistive post across the axis of the table controlling a torsion on the knee.

In an alternative embodiment, the invention provides a surgical leg positioning unit for positioning a leg of a human patient with the patient lying supine on an upper surface of a surgical table and the patient's inferior/superior axis generally aligned with an axis of the table. The positioning unit has a foot bridal for receiving the patient's foot of the leg when the patient's knee of the leg is bent and extending upward from the table and tensioned away from an attachment point of the leg; a cord attached between the foot bridal and the upper surface of the surgical table providing a downward tensile force on the foot bridal; and a resistive post extending laterally over the upper surface of the surgical table and positioned to abut the lower portion of the patient's thigh underneath the knee and cooperating with the foot bridal to provide a tensile force on the leg of the patient.

It is thus a feature of at least one embodiment of the invention to stretch the patient's leg in a direction of the normal extent of the leg in order to open up the ankle joint during ankle arthroscopy for improved visualization.

DETAILED DESCRIPTION OF THE PREFERRED EMBODIMENT

Embodiment 1

Figure 1:
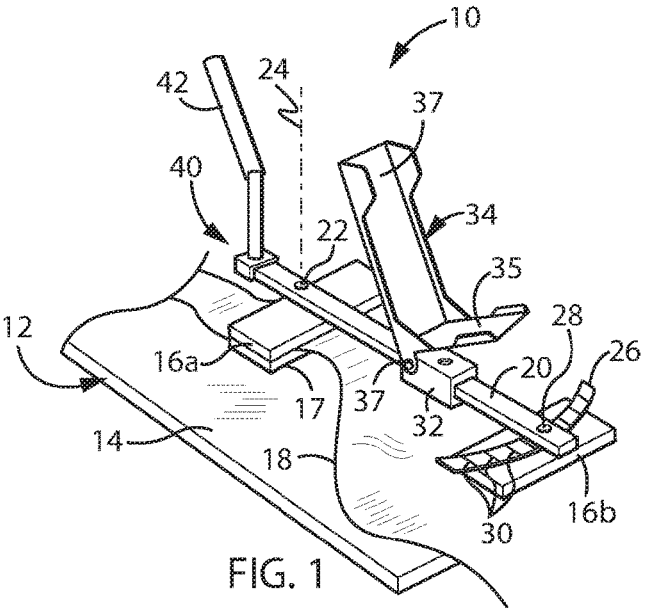
FIG. 1 is a perspective view of a first embodiment of the fixture of the present invention as attached to a surgical table through a surgical drape prior to positioning of the patient.
Figure 2:
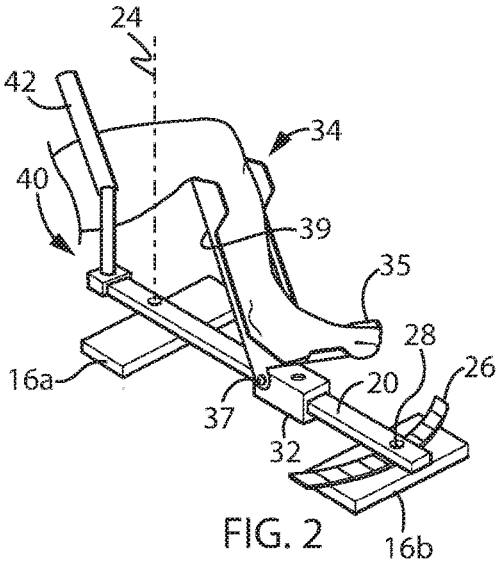
FIG. 2 is a figure similar to that of FIG. 1 showing the patient's leg position on the fixture.

Referring now to FIG. 1, a knee torsion system 10 may work in conjunction with a standard surgery table 12 of the type providing a generally horizontal table top surface 14. Proximal and distal mounting plates 16*a* and 16*b* may be fixed with respect to the table top surface 14 through underlying base plates 17 positioned below a surgical drape 18 to attach directly to the table 12 as disclosed in the above referenced application.

A rigid rail 20 may extend between the mounting plates 16 to attach to the proximal mounting plates 16*a* at a pivot joint 22 allowing the rail 20 to pivot with respect to the mounting plates 16*a* about a vertical axis 24 normal to the table top surface 14. The rigid rail 20 attaches to the distal mounting plates 16*b* through an arcuate track 26 having a constant radius about axis 24 and lying generally in a plane parallel to the table top surface 14 and fixed with respect to the distal mounting plates 16*b*. A lock mechanism 28 allows the distal end of the rail 20 to lock at regular detent positions 30 on the arcuate track 26 so that the angle at which the rail 20 pivots about the axis 24 with respect to the table 12 may be changed. The angular range of rotation will typically be 20 degrees and may be, for example, 30 degrees. The lock mechanism may automatically lock at any detent position and may be manually unlocked to allow for further rotation.

A slide 32 may fit on the rail 20 to slide along the length of the rail 20 between the pivot joint 22 and the arcuate track 26. The slide 32 may be locked into any location along the rail 20 by means of a manual lock element (not shown). A foot stirrup 34 may be pivotally attached to the top of the slide 32 at a horizontal pivot 37 that also allows removal of the foot stirrup 34 and the locking of the foot stirrup 34 in an angle about the horizontal pivot 37, for example, as described in the above referenced application with respect to FIG. 8. The foot stirrup 34 may also include a soleplate 35 supporting a sole of the patient's foot and a calf support 39 supporting the patient's calf. It will be appreciated that by adjustment of the angle of the rail 20 and the location of the slide 32, a knee 36 of the patient may be positioned above the axis 24 at a desired angulation.

Figure 3:
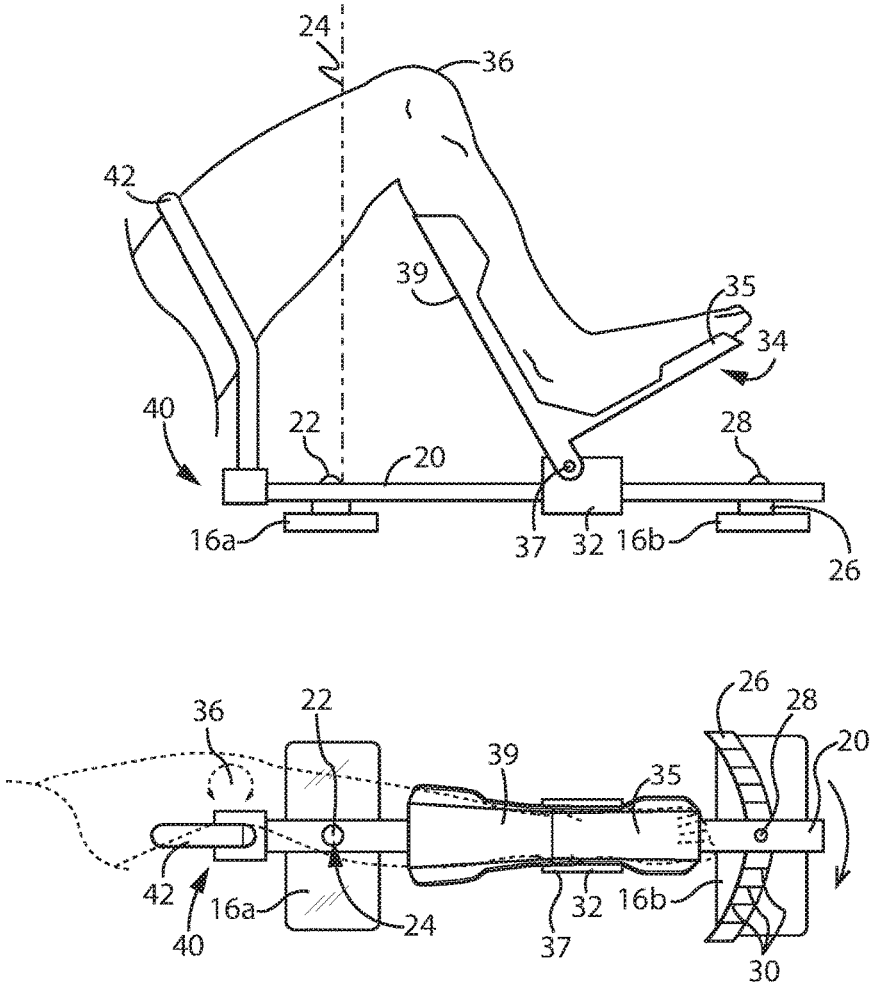
FIG. 3 is a side elevational and top plan view of the fixture showing the patient leg in phantom as positioned on the fixture.

Referring now also to FIG. 3, the rail 20 extends away from the slide 32 past the pivot joint 22 to a cantilevered arm portion 40 that supports an upwardly extending restraint arm 42 that may be positioned either to the inside or outside of the patient's thigh above the knee 36. It will be appreciated that by angulation of the rail 20 about the axis 24, countervailing forces may be applied to a patient's leg above and below the knee 36 to provide torsion of the desired direction and amount on the knee joint itself.

This knee torsion system 10 is superior to the current practice in four ways. 1. It does not require a second person to apply the torsional force. 2. Due to the leverage of the rail, the force is easily applied with one hand. 3. The force stays in place until purposefully relieved via the interlocking portions of the main rail and arcuate track. This leaves the surgeon with both hands available to perform the procedure. 4. The fixed position of the rail eliminates movement of the patient caused by a third person applying force manually.

Embodiment 2

Figure 4:
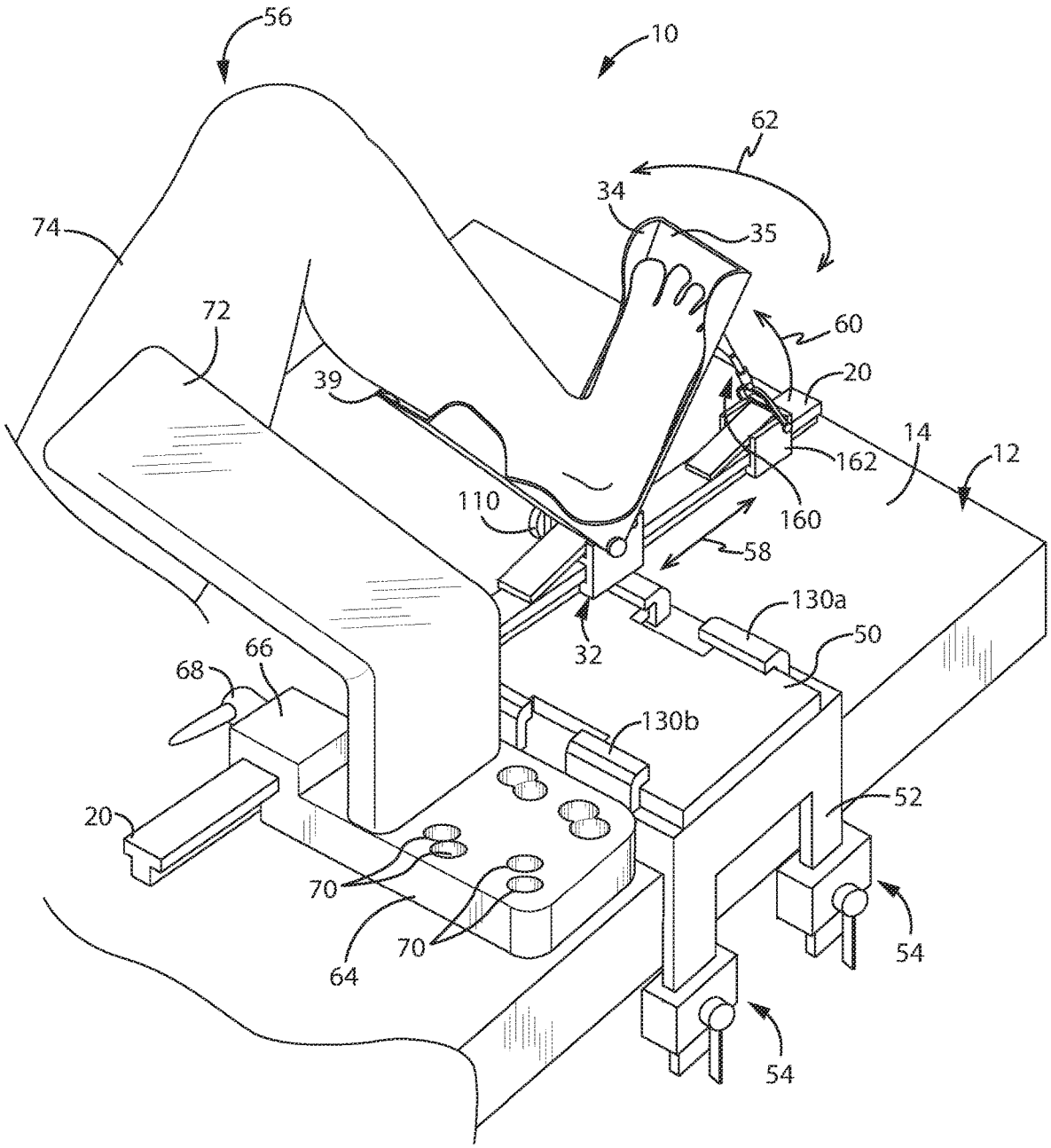
FIG. 4 is a perspective view in fragment of a second embodiment of the fixture of the present invention.

Referring now to FIG. 4, in an alternative embodiment, the rail 20 may be attached to a horizontally extending mounting plate 50 that may be attached to a foundation 52 with the latter attached to the table 12 by a standard table clamping system 54. The rail 20 will extend generally along an axis of the table 12 from the head to the foot of the table 12 without rotation as is provided in the first embodiment.

As before, a foot stirrup 34 may support the foot and leg of a patient 56 lying face upward on the table surface 14. The foot stirrup 34 attaches to a slide 32 that may be adjusted along the rail 20 and thus along the table axis 58 extending between the foot and head of the table 12. As will be discussed in more detail below, the foot stirrup 34 may also be adjusted in angulation 60, such as generally changes the dorsiflexion and plantar flexion of the foot and, separately, the internal or external rotation 62 of foot.

The rail 20 may support not only the slide 32 but also a thigh support mounting plate 64 that may abut the upper surface of the table 12 (separated from the table 12 by a surgical drape) extending laterally from the rail 20. The thigh support mounting plate 64 attaches to the rail 20 by means of a slide 66 receiving the rail 20 allowing the thigh support mounting plate 64 to be adjustable along axis 58 with release of a clamp 68 on the slide 66. The clamp 68, for example, may operate a threaded element which may tighten against the rail 20.

The upper surface of the thigh support mounting plate 64 provides for a series of vertically oriented and laterally spaced bores 70 that may receive corresponding downwardly extending pins (not shown) in a lateral thigh support post 72. The lateral thigh support post 72 extends upward from the thigh support mounting plate 64 and then angles slightly in the superior direction of the patient along axis 58 to abut one side of the patient's thigh 74 when the patient's knee is bent and their foot is received within the foot stirrup 34. Construction of the lateral thigh support post 72 is described, for example, in U.S. provisional application 62/256,351, filed Nov. 17, 2015, hereby incorporated by reference.

The different bores 70 permit placement of the lateral thigh support post 72 at different lateral distances from the rail 20 to complement its motion along the rail 20 by means of slide 66. Different shapes of lateral thigh support posts including different angulations and heights may be provided to accommodate a wide variety of different surgical requirements.

Figure 5:
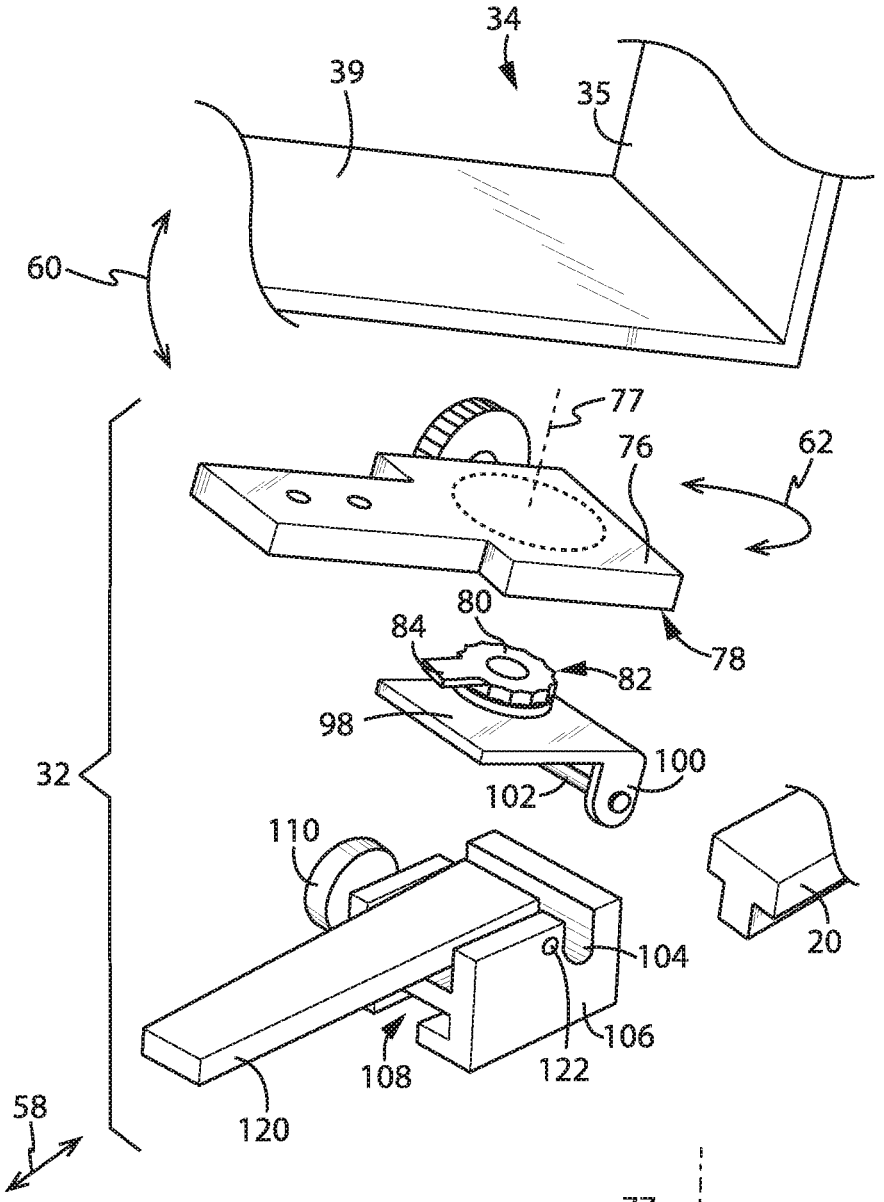
FIG. 5 is an exploded diagram of a foot stirrup of the second embodiment having a mounting providing angulation and rotation of the ankle and lower leg.
Figure 6:
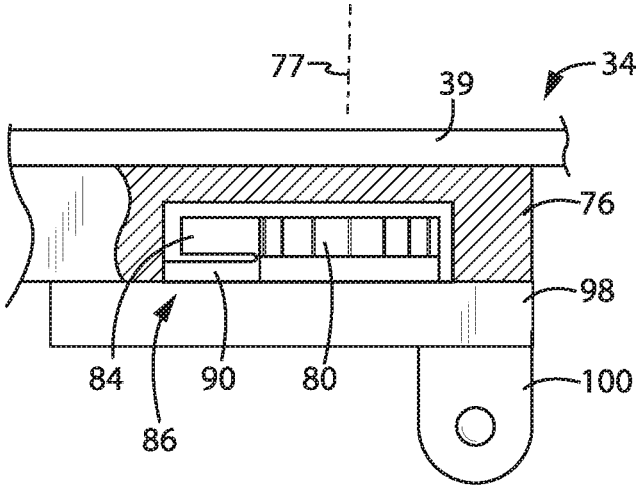
FIG. 6 is a fragmentary partial cross-section of the rotation mechanism of the mounting of FIG. 5.
Figure 7:
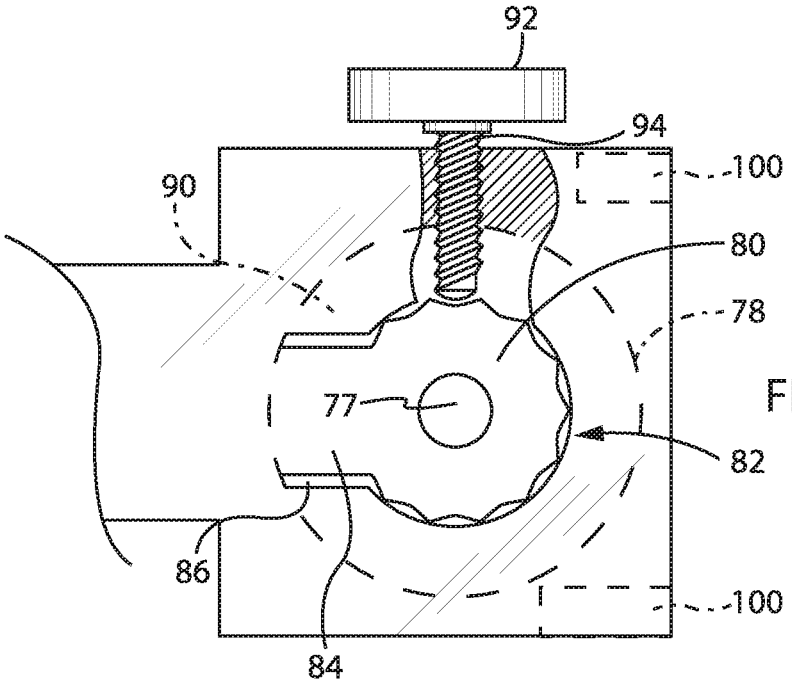
FIG. 7 is a top view of the rotation mechanism of FIG. 6 in partial cutaway.

Referring now to FIGS. 5, 6 and 7, the lower surface of the calf support 39 of the foot stirrup 34 may be fixed to an upper swivel coupling 76 (for example, by weld or machine screws or the like), the upper swivel coupling 76 allowing swivel rotation 62 of the foot stirrup 34 about an axis 77. The lower surface of the upper swivel coupling 76 in turn provides a socket 78 that may receive a scalloped detent wheel 80 coaxially therein when the upper swivel coupling 76 is in a first rotational alignment about axis 77 with alignment as shown. The key detent wheel 80 provides a tooth perimeter 82 interrupted at a front edge by a radially extending key tab 84. In the alignment as shown, the key tab 84 may be received within a corresponding key opening 86 in the upper swivel coupling 76 while the scalloped detent wheel 80 is received in a cylindrical socket communicating with the key opening 86.

Rotation of the upper swivel coupling 76 away from the alignment position, as shown, causes the key tab 84 to be captured by a retention ridge 90 in the upper swivel coupling 76 passing below the tab 84 and preventing upward removal of the upper swivel coupling 76 except in the alignment as shown.

As shown best in FIG. 7, a locking knob 92 may attach to a threaded shaft 94 received by a corresponding threaded hole in the upper swivel coupling 76, the threaded hole passing generally along a radial axis perpendicular to axis 77 with respect to the keyed detent wheel 80. The tip of the threaded shaft 94, when the locking knob 92 is tightened, may be received within a scallop of the scalloped detent wheel 80 blocking the rotation between the upper swivel coupling 76 and the detent wheel 80 when desired.

The detent wheel 80 may be fixed to a lower swivel coupling 98 with respect to which the upper swivel coupling 76 may swivel about axis 77.

Extending downward from the lower swivel coupling 98 at opposed edges along a common lower edge are tabs 100 which support between them a hinge pin 102 extending generally longitudinally and perpendicular to the extent of the rail 20 shown in FIG. 4. This hinge pin 102 may be received within an upwardly open longitudinal slot 104 in slider block 106. The slider block 106 may receive the rail 20 to slide therealong in the manner of slide 32. An adjustment knob 110 may be provided on the side of the slider block 106 providing a locking screw (not shown) that may serve to lock the sliding block 106 in a particular location along the rail 20.

Figure 8:
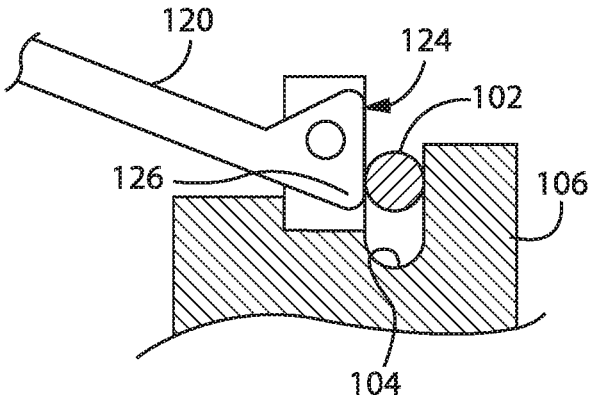
FIGS. 8 and 9 are vertical cross-sections through a mounting showing the steps of release and engagement of the foot stirrup.
Figure 9:
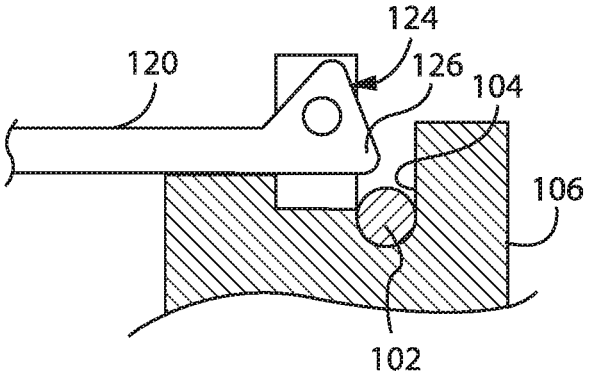

Referring also to FIGS. 8 and 9, one vertical wall of the slot 104 in the upper surface of the slider block 106 may be removed in part to receive an end 124 of a quick release handle 120. The opposite end of the quick release handle 120 extends generally along the axis 58 where it may be easily manipulated by the user. The quick release handle 120 is mounted to pivot about a laterally extending pivot pin 122 extending through sidewalls of the block 106 and through an end of the pivot handle 120.

The end 124 roughly approximates the missing wall of the slot 104 and may be moved by moving pivot handle 120 to permit receipt of the hinge pin 102 and capture of the hinge pin 102 in the slot 104 until released by movement of the handle 120.

In this regard, as shown in FIG. 8, when handle 120 is elevated, the end 124 becomes substantially vertical and continuous with the walls of the slot 104 to permit reception of the hinge pin 102 in the slot 104. As shown in FIG. 9, when the handle 120 is dropped, a lower portion 126 of the end 124 of the handle 120 projects into the slot 104 to prevent the hinge pin 102 from escaping. Upward motion of the hinge pin 102 strikes this lower portion 126 further locking it against the proper direction of rotation needed to release the hinge pin 102.

It will be appreciated that the motion of the foot stirrup 34 in angulation 60 is provided by rotation of the hinge pin 102 in the slot 104 while swiveling of rotation 62 is provided by rotation of the upper swivel coupling 76 with respect to the lower swivel coupling 98. Extension of the foot along the rail 20 is provided by sliding of the block 106.

Figure 10:
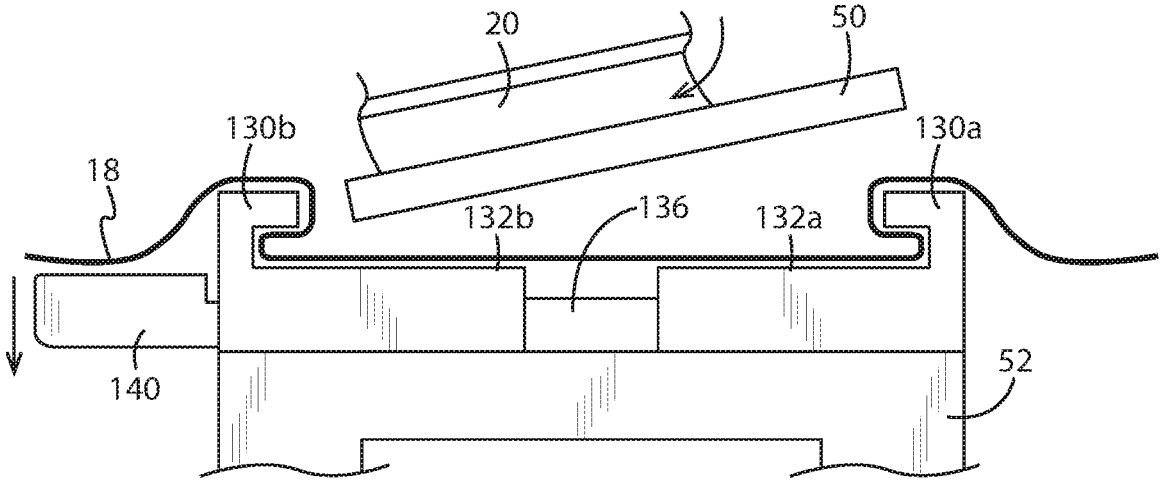
FIG. 10 is a side elevational view of a table mount for receiving the present invention through a sterile field defined by a polymer sheet.
Figure 11:
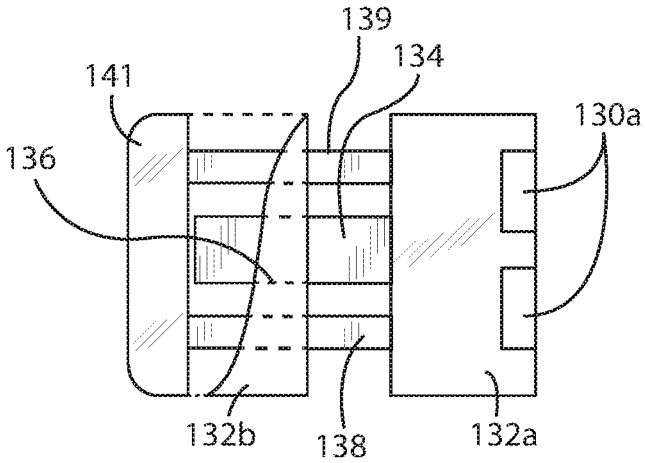
FIG. 11 is a top plan view in partial fragment of the table mount showing a mechanism for allowing snap engagement of the mount to the fixture.

Referring now to FIGS. 4 and 10, the foundation 52 may be separated from the mounting plate 50, the latter attached to the rail 20, by a sterile drape 18. In this regard, the foundation 52 may provide horizontally opposed retention hooks 130*a* and 130*b* that may be separated slightly to admit the mounting plate 50 therebetween, and then the retention hooks 130*a* and 130*b* closed together to firmly grip the mounting plate 50 through the sterile drape 18.

The retention hook 130*b* may be mounted on a first plate portion 132*b* attached to the foundation 52 fixedly and thus fixed with respect to the table 12. A guide bar 134 may extend horizontally from plate 132*a*, plate 132*a* holding hook 130*a*, to be received in a corresponding channel 136 in the plate 132*b*. Engagement of the guide bar 134 and channel 136 allows the plates 132*a* and 132*b* to move freely toward and away from each other.

Plate 132*a* also includes spring bars 138 and 139 attached to and extending from the plate 132*a* parallel to and on either side of guide bar 134 beneath the plate 130. These spring bars 138 and 139 attached to a plate stop 141. When the plates 132*a* and 132*b* are positioned together, firmly holding the mounting plate 50 in the hooks 130*a* and 130*b*, the plate stop 141 extends beyond the leftmost edge of plate 132*b* and is biased upward by the spring bars 138 and 139 to engage the left outer surface of plate 132*b* preventing separation of the plates 132*a* and 132*b* to firmly hold the mounting plate 50. The plates 132*a* and 132*b* may be separated by pressing downward on the plate stop 141 with flexure of the spring bars 138 and 139, allowing the plate stop 141 to pass beneath the plate 132*b* with separation of the plates 132*a* and 132*b* to release the mounting plate 50.

Figure 12:
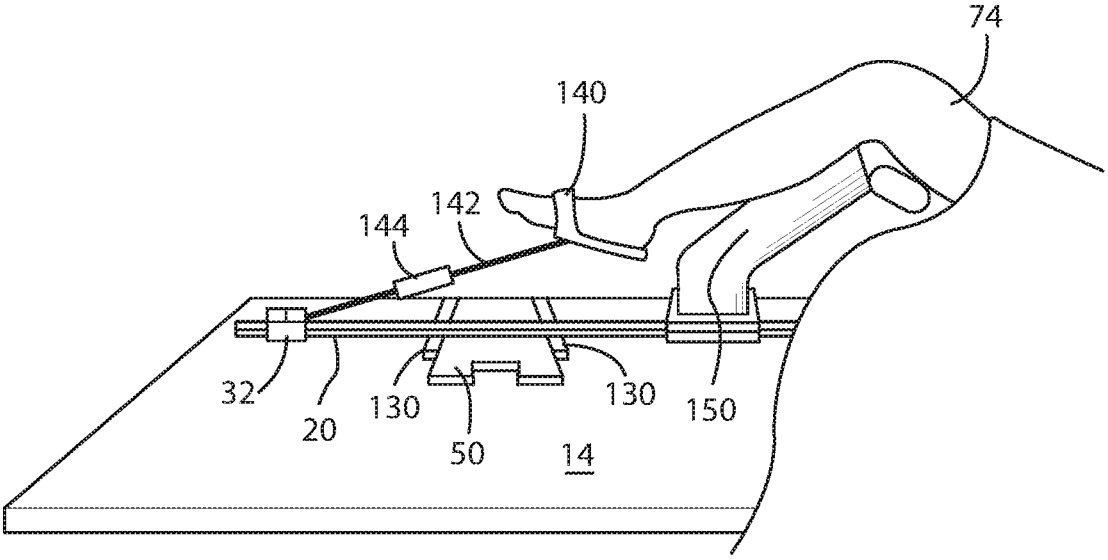
FIG. 12 is a perspective elevational view of the fixture of the present invention used for ankle arthroscopy.
Figure 13:
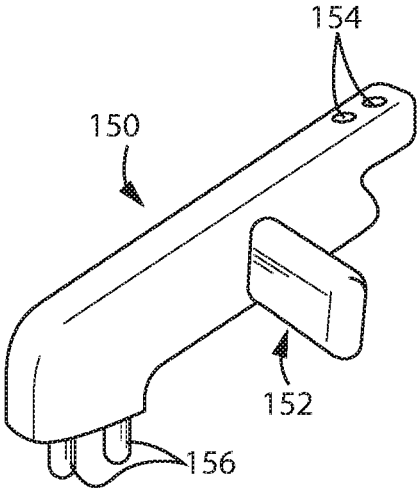
FIG. 13 is a perspective view of the lake support used in the ankle arthroscopic system of FIG. 12.

Referring now to FIGS. 12 and 13, the present invention including the rail 20, the mounting plate 50, and the slide 32 may also be used for other procedures such as ankle arthroscopy in which a flexible foot bridal 140 attached to the patient's foot may be connected in tension by cord 142 to the slide 32, the cord 142 tensioned by tension adjuster 144. In this case, the lateral thigh support post 72 may be replaced with a leg support post 150 extending upward from the table surface 14 and having a knee support arm 152 extending laterally over the surface 14 of the table 12 to support the lower portion of the patient's thigh 74 beneath the knee. An upper distal end of the leg support post 150 may include sockets 154 for holding surgical tools and the lower proximal end of the leg support post 150 may have downwardly extending pins 156 to be received within bores 70 of the thigh support mounting plate 64 shown in FIG. 1.

Figure 14:
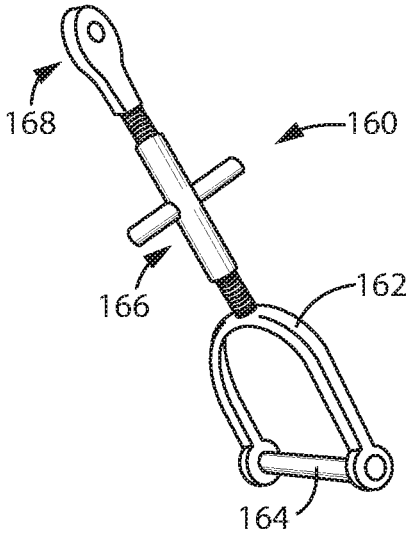
FIG. 14 is a view of a stabilizer harness used on the foot support of FIG. 4.

Referring now to FIGS. 4 and 14, a tension strap 160 may be attached between the lower side of the soleplate 35 of the foot stirrup 34 and a second slide 162 similar to slide 32 but positioned on the inferior end of rail 20. The lower end of the tension strap 160 may provide for a stirrup 162 having a crossbar 164 fitting within the slot of the slide 162 similar to slot 104 of slide 32 and retained therein by corresponding handle 120. A turnbuckle adjustment 166 joins the stirrup 162 with a clevis joint 168 that may releasably attached to a loop (not shown) on the bottom of the soleplate 35. By tensioning the turnbuckle 166, upward pressure from the calf support 39 may be applied to the patient's lower leg effected through a pivot point of hinge pin similar to hinge pin 102 shown in FIG. 5.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A surgical leg positioning unit for positioning a leg of a human patient with the patient lying supine on an upper surface of a surgical table and the patient's inferior/superior axis generally aligned with an axis of the table, the positioning unit comprising:

a soleplate sized to receive a sole of the patient's foot of the leg when the patient's knee is upward and bent to restrain the foot against free angulation of a foot axis extending along a length of the patient's foot;

a calf plate attached to the soleplate and sized and positioned to support a back of the patient's calf of the leg when the patient's foot is received by the soleplate and restraining the calf against free angulation of a calf axis extending along a length of the patient's calf when the calf of the patient is received by the calf plate;

a support fixable against the upper surface of the surgical table providing a pivoting attachment to at least one of the soleplate and the calf plate; and a thigh support attached to the support and extending upward therefrom to abut the patient's thigh of the leg proximate the knee to restrain the patient's thigh with respect to the calf of the leg with torsion on the calf when the supine patient's knee is upward and bent and the foot of the patient is received by the soleplate;

wherein the soleplate and calf plate join to provide a continuous surface therebetween.

2. The positioning unit of claim 1 wherein the foot axis of the foot plate and calf axis of the calf plate are perpendicular.

3. The positioning unit of claim 1 wherein the soleplate provides upwardly extending lateral wings flanking the soleplate to restrain movement of the foot and angulation about an axis of the foot.

4. The positioning unit of claim 1 wherein the soleplate and lateral wings surround the foot on the soleplate by varying amounts as one moves from a portion of the soleplate adjacent to a heel of the supported foot to a portion of the soleplate adjacent to a toe of the supported foot.

5. The positioning unit of claim 4 wherein the lateral wings on the soleplate have variable height measured perpendicularly to the soleplate surface to provide improved contact between the foot and a wrapping of the soleplate to stabilize the foot.

6. The positioning unit of claim 5 wherein the lateral wings of the soleplate have a greater height in proximity to the toe of a patient's foot positioned on the soleplate then a height closer to an ankle of the foot.

7. The positioning unit of claim 5 wherein the lateral wings have a greater height at opposite ends of the soleplate than at its center along the foot axis.

8. The positioning unit of claim 1 wherein the calf plate provides upwardly extending lateral wings flanking the calf plate to restrain movement of the calf and angulation about an axis of the calf.

9. The positioning unit of claim 1 wherein the calf plate and lateral wings surround the calf on the calf plate by varying amounts as one moves from a portion of the calf plate adjacent to a knee of the supported leg to a portion of the calf plate adjacent to the foot of the supported leg.

10. The positioning unit of claim 9 wherein the lateral wings on the calf plate have variable height measured perpendicularly to the calf plate surface to provide improved contact between the calf and a wrapping of the calf plate to stabilize the calf.

11. The positioning unit of claim 10 wherein the lateral wings of the calf plate have a greater height in proximity to the knee of a patient's leg positioned on the calf plate then a height closer to the foot.

12. The positioning unit of claim 10 wherein the lateral wings have a greater height at opposite ends of the calf plate than at its center along the calf axis.

13. The positioning unit of claim 1 further providing a gusset connecting peripheral walls of the calf plate and soleplate.

14. The positioning unit of claim 1 further comprising a pivot joint attached to at least one of the soleplate and calf plate and pivoting the soleplate and calf plate about a horizontal pivot axis parallel to the upper surface of the surgical table.

15. The positioning unit of claim 14 wherein the pivot joint further includes a lock locking a rotation of the soleplate and calf plate about the pivot axis.

16. The positioning unit of claim 1 wherein the thigh support extends upward from the support and then angles slightly in the superior direction of the patient to abut the patient's thigh of the leg.

17. The positioning unit of claim 1 further comprising a rail extending along a length of the upper surface of the surgical table and coupled to at least one of the soleplate and calf plate engaging the rail to permit sliding of the soleplate and calf plate horizontally along the rail.

18. The positioning unit of claim 17 wherein the rail is attached to at least one mounting plate attachable to the surgical table.

19. The positioning unit of claim 17 wherein the rail is further coupled to the thigh support engaging the rail to permit sliding of the thigh support horizontally along the rail.

20. The positioning unit of claim 1 wherein the continuous surface between the soleplate and the calf plate is gapless preventing migration of debris between the soleplate and the calf plate.

21. The positioning unit of claim 1 further comprising a plate extending parallel to the soleplate and supporting a lower surface of the soleplate and attached to the soleplate by at least one of a weld and a screw attachment.

22. The positioning unit of claim 21 wherein the plate is attached to the soleplate by a weld preventing migration of debris between the plate and the soleplate.

* * * * *